US007861559B2

(12) United States Patent
Lonati et al.

(10) Patent No.: US 7,861,559 B2
(45) Date of Patent: Jan. 4, 2011

(54) YARN FEEDING DEVICE FOR KNITTING MACHINES, PARTICULARLY FOR CIRCULAR KNITTING MACHINES

(75) Inventors: Ettore Lonati, Botticino (IT); Tiberio Lonati, Brescia (IT); Fausto Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 12/310,134

(22) PCT Filed: Sep. 7, 2007

(86) PCT No.: PCT/EP2007/007830

§ 371 (c)(1),
(2), (4) Date: Feb. 12, 2009

(87) PCT Pub. No.: WO2008/037339

PCT Pub. Date: Apr. 3, 2008

(65) Prior Publication Data

US 2010/0000262 A1 Jan. 7, 2010

(30) Foreign Application Priority Data

Sep. 29, 2006 (IT) ..... MI2006A1877

(51) Int. Cl.
*D04B 27/10* (2006.01)

(52) U.S. Cl. ..... 66/140 R

(58) Field of Classification Search ..... 66/134–139, 66/140 R, 142, 125 R
See application file for complete search history.

(56) References Cited

U.S. PATENT DOCUMENTS 4,193,274 A * 3/1980 Gostelow ..... 66/140 R
4,385,507 A * 5/1983 Sawazaki ..... 66/140 R
4,404,821 A * 9/1983 Johnson et al. ..... 66/139
4,606,202 A * 8/1986 Del Bene et al. ..... 66/134
4,656,842 A * 4/1987 Sawazaki et al. ..... 66/139
5,046,333 A * 9/1991 Sawazaki et al. ..... 66/140 R
5,070,709 A * 12/1991 Guell ..... 66/140 R
5,218,845 A * 6/1993 Wang ..... 66/139
5,237,841 A 8/1993 Lonati et al.
5,826,446 A * 10/1998 Plath et al. ..... 66/140 R
6,000,245 A * 12/1999 Plath et al. ..... 66/139
6,408,655 B1 * 6/2002 Ossensi et al. ..... 66/140 R
6,655,176 B1 12/2003 Wang
7,036,343 B1 * 5/2006 Wei ..... 66/140 R
7,055,348 B1 * 6/2006 Wei ..... 66/140 R
7,073,355 B2 * 7/2006 Traenkle et al. ..... 66/138
7,690,224 B1 * 4/2010 Wei ..... 66/140 R

* cited by examiner

*Primary Examiner*—Danny Worrell
(74) *Attorney, Agent, or Firm*—Modiano & Associati; Albert Josif; Daniel O'Byrne

(57) ABSTRACT

A device for feeding yarns for knitting machines comprising a supporting element arranged on the inner side of the machine bed which supports a set of yarn guides arranged side-by-side. Each of the yarn guides has a passage for at least one yarn to be fed to the needles of the machine arranged in the bed and the supporting element, for each of the yarn guides, supports an element for clamping and cutting the yarn dispensed by the corresponding yarn guide. A first actuator for the yarn guides is provided for the passage of the yarn guides from an inactive position to an active position, and a second actuator is provided for actuating the clamping and cutting elements. The first actuator comprises individual actuators actuated to produce passage of each of the yarn guides from the inactive position to the active position or vice versa.

13 Claims, 9 Drawing Sheets

YARN FEEDING DEVICE FOR KNITTING MACHINES, PARTICULARLY FOR CIRCULAR KNITTING MACHINES

The present invention relates to a yarn feeding device for knitting machines, particularly for circular knitting machines.

BACKGROUND OF THE INVENTION

As is known, circular knitting machines are equipped with one or more sets of yarn guides which are designed to dispense one or more yarns to the needles of the machine and are arranged in a circular bed. The yarn guides and the bed of the machine move with respect to each other, so that the yarn guides can dispense the yarns to the various needles arranged side-by-side inside the bed.

In some kinds of machines, the bed is fixed while the yarn guides are mounted on a supporting element which is actuated with a rotary motion about the axis of the bed with respect to the bed. In this case, the needle actuation cams also are actuated, together with the yarn guide supporting element, with a rotary motion about the axis of the bed so as to cause the movement of the needles which forms the knitting.

In other types of machines, the yarn guide supporting element and the needle actuation cams are fixed and the bed is actuated with a rotary motion about its own axis.

Each yarn guide has, proximate to one of its ends directed toward the bed of the machine, a passage for the yarn to be dispensed, which arrives from a spool or from a yarn magazine.

In order to change the yarns delivered to the needles during knitting, for example to form patterns, each yarn guide can move on command from an inactive position, in which it is arranged so that its passage for the yarn lies on the inner side of the bed, i.e., between the bed and the axis of the bed, to an active position, in which it is arranged so that its passage for the yarn lies on the outer side of the bed, and vice versa. In this manner, when the yarn guide is in the active position, the yarn dispensed by the yarn guide straddles the bed and its engagement by the needles that are moved to knit is ensured, while when the yarn guide is in the inactive position the passage for the yarn is arranged inside the bed, preventing the engagement of the yarn by the needles.

These devices are generally equipped, for each yarn guide, with an element for clamping and cutting the yarn dispensed by the corresponding yarn guide. Such clamping and cutting element is designed to retain the yarn by clamping while the corresponding yarn guide is in the inactive position, to release the yarn when the corresponding yarn guide is moved into the active position, and to engage the yarn again and cut it when the corresponding yarn guide is returned to the inactive position. To do this, each clamping and cutting element can move toward and away from the bed in order to pass from a position for clamping the yarn to position for waiting for the yarn to be clamped and vice versa.

In known types of devices there is generally a single actuator to produce the passage of the yarn guides from the inactive position to the active position, and each yarn guide can be moved on command, by means of a corresponding individual actuation element, from a deactivation position, in which it is excluded from the action of this actuator, to an activation position, in which it can undergo the action of the actuator.

Usually, the actuator that acts on the yarn guides that are in the activation position is arranged in a specific region of the bed which is dedicated specifically to the operation for changing the yarn guides that are being used and is constituted generally by a cam. Likewise, in the same region of the bed there is generally another actuator, usually another cam, which produces the passage of the yarn guides that are in the active position from the active position to the inactive position.

In known types of devices, due to the fact that the actuators that actuate the passage of the yarn guides from the inactive position to the active position are arranged at a preset region of the bed, it is not possible to change the yarn guides that are active except at such region and therefore it is not possible to limit the dispensing of a yarn to a region of a formed row of knitting, but the yarn must be dispensed for an entire row of knitting. This fact constitutes a limitation of the kinds of knitting that can be performed with machines equipped with these devices.

SUMMARY OF THE INVENTION

The aim of the present invention is to provide a yarn feeding device for knitting machines, particularly for circular knitting machines, which allows to increase the number of kinds of knitting that are possible on a machine.

Within this aim, an object of the invention is to provide a device which, while allowing higher flexibility in yarn feeding, in combination with the numerous possibilities of needle selection that are already provided in modern knitting machines, allows to increase considerably the range of kinds of knitting that can be performed with a knitting machine, particularly with a circular knitting machine.

Another object of the invention is to provide a device which can be installed simply in currently commercially available knitting machines.

Still another object of the invention is to provide a device which ensures high precision in the supply of the yarns to the needles of the machine.

This aim and these and other objects which will become better apparent hereinafter are achieved by a device for feeding yarns for knitting machines, particularly for circular knitting machines, which comprises a supporting element which can be arranged on the inner side of the bed of the machine to be fed and supports a set of yarn guides arranged mutually side-by-side; said bed being able to move with respect to said supporting element along an actuation path; each of said yarn guides having a passage for at least one yarn to be fed to the needles of the machine that are arranged in said bed and said supporting element, for each of said yarn guides, supporting an element for clamping and cutting the yarn dispensed by the corresponding yarn guide; first means for actuating the yarn guides being provided for the passage of said yarn guides from an inactive position, in which they are arranged so that their yarn passage lies on the inner side of the bed, to an active position, in which they are arranged so that their yarn passage lies on the outer side of the bed, or vice versa, and second means being provided for actuating the clamping and cutting elements for the passage of the clamping and cutting elements from a position for clamping the yarn to a position for waiting for the yarn to be clamped; characterized in that said first actuation means are arranged on said supporting element and comprise individual actuators which can be actuated to produce the passage of each of said yarn guides from said inactive position to said active position or vice versa, independently of the actuation of the other yarn guides and independently of the position of said bed with respect to said supporting element along the corresponding actuation path.

BRIEF DESCRIPTION OF THE DRAWINGS

Further characteristics and advantages of the device according to the invention will become better apparent from the description of a preferred but not exclusive embodiment of the device according to the invention, illustrated by way of non-limiting example in the accompanying drawings, wherein.

Figure 1:
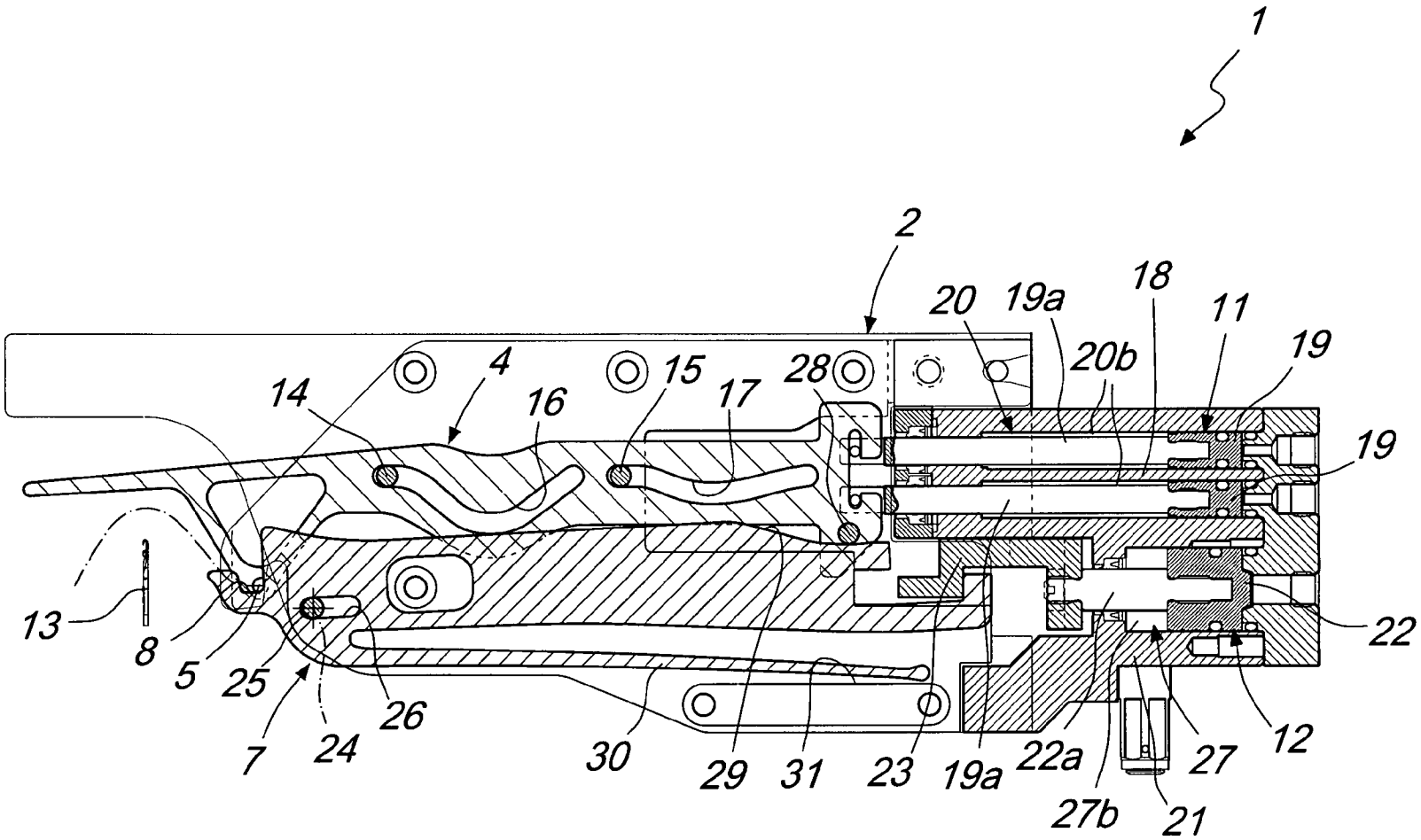
FIG. 1 is a partially sectional view of the device according to the invention, with a yarn guide in the inactive position and with the clamping and cutting element in the clamping position and in a first active position.

In the figures, the device according to the invention has been shown, for the sake of simplicity and greater clarity, only as regards one yarn guide and the corresponding clamping and cutting element, but the device according to the invention is composed of a set of at least two yarn guides with the corresponding clamping and cutting elements, one for each of the yarn guides.

DESCRIPTION OF THE PREFERRED EMBODIMENTS

With reference to the figures, the device according to the invention, generally designated by the reference numeral 1, comprises a supporting element 2, which can be positioned on the inner side of the bed 3 of the machine to be fed with the yarns and supports a set of yarn guides 4 arranged mutually side by side.

The device according to the invention is designed to be mounted preferably on a circular knitting machine, particularly a machine with a diameter ranging substantially from 10 to 60 inches. In this case, to which the figures refer, the bed 3 is constituted by the upper end of the needle cylinder of the machine, which has a vertical axis. Depending on the type of circular machine, the supporting element 2 can be fixed while the bed 3, or the needle cylinder, is actuated with a rotary motion about its own axis, or the supporting element 2 can be able to rotate about the axis of the bed 3 or of the needle cylinder while the bed 3 is fixed.

Each yarn guide 4 has an elongated laminar body which is arranged on a preferably vertical plane which is substantially perpendicular to the actuation path of the bed 3 with respect to the supporting element 2 or vice versa and is provided, proximate to one of its longitudinal ends directed toward the bed 3, with a passage 5 for at least one yarn 6 which arrives, in a per se known manner, from a yarn spool or magazine.

The supporting element 2 for each of the yarn guides 4 supports a clamping and cutting element 7 for the yarn 6 dispensed by the corresponding yarn guide 4.

The clamping and cutting element 7 also has an elongated laminar body, which is also arranged on a plane which is substantially perpendicular to the actuation path of the bed 3 with respect to the supporting element 2 or vice versa. Such clamping and cutting element 7 is arranged laterally and below the corresponding yarn guide 4 and has, proximate to its longitudinal end directed toward the bed 3, a recess 8 which is open upwardly and is designed to receive the yarn 6, as will become better apparent hereinafter.

Laterally and on mutually opposite sides with respect to the clamping and cutting element 7, there are two laminas, respectively a cutting lamina 9 and a retention lamina 10, between which the clamping and cutting element 7 can slide.

The retention lamina 10 is arranged between the clamping and cutting element 7 and the yarn guide 4, while the cutting lamina 9 is provided with a sharp profile 9*a*, which is designed to cooperate with one side of the recess 8 which acts as a contrast blade, and is laterally adjacent to the opposite side of the clamping and cutting element 7.

In practice, the retraction of the clamping and cutting element 7 between the laminas 9 and 10, with the yarn 6 deposited in the recess 8, achieves the clamping of the yarn 6 between the retention lamina 10 and the clamping and cutting element 7 and the cutting of the yarn 6 between the cutting lamina 9 and the clamping and cutting element 7.

The device comprises first means 11 for actuating the yarn guides 4 in order to produce their passage from an inactive position, in which they are arranged so that their passage 5 lies on the inner side of the bed 3, to an active position, in which they are arranged so that their passage 5 lies on the outer side of the bed 3 or vice versa. Moreover, the device according to the invention comprises second means 12 for actuating the clamping and cutting elements 7 in order to produce the passage of the clamping and cutting elements 7 from a position for clamping the yarn 6, in which they retain the yarn 6, to a waiting position, in which they release the yarn 6 and wait for the deposition of the yarn 6 in the recess 8.

According to the invention, the first actuation means 11 are arranged on the supporting element 2 and comprise individual actuators, which can be actuated in order to produce the passage of each of the yarn guides 4 from the inactive position to the active position or vice versa, independently of the actuation of the other yarn guides 4 and independently of the position of the bed 3 with respect to the supporting element 2 along the actuation path of the bed 3 with respect to the supporting element 2, i.e., along the actuation path followed by the bed 3 if said bed can move with respect to the fixed supporting element 2 or followed by the supporting element 2 if the latter can move with respect to the fixed bed 3.

More particularly, each yarn guide 4 is supported by the supporting element 2 so that it can slide along an actuation direction which is oriented transversely to the extension of the bed 3 and transversely to the actuation path of the bed 3 with respect to the supporting element 2. In practice, in the case of a circular bed 3, as in the illustrated case, each yarn guide 4 can slide along a radial direction with respect to the bed 3.

Moreover, each yarn guide 4 is supported by the supporting element 2 also so that it can slide, on its plane of arrangement, along a direction which is substantially perpendicular to the actuation direction. In the case of a circular bed 3, as in the illustrated case, each yarn guide 4 can also slide vertically, i.e., parallel to the axis of the bed 3.

The supporting element 2 is provided with guiding means which define a movement path for each yarn guide 4 in its passage from the inactive position to the active position and vice versa. This movement path is shaped so as to have an intermediate lifting portion followed by a lowering portion in order to allow the end of the yarn guide 4, in which the passage 5 is defined, to move beyond the region of the bed 3 that supports the needles 13 when the yarn guide 4 passes from the inactive position to the active position and vice versa.

In particular, the guiding means comprise two pins 14, 15, which are fixed to the supporting element 2 and are oriented at right angles to the planes of arrangement of the several laterally adjacent yarn guides 4; such pins 14, 15 pass through corresponding contoured through slots 16, 17 defined within the body of the yarn guides 4. The slots 16, 17 have a sliding coupling with the corresponding pin 14, 15 and are contoured so as to allow the passage of the corresponding yarn guide 4 from the inactive position to the active position or vice versa, by way of a movement of the yarn guide 4 along an actuation direction which lies transversely to the bed 3 and to the actuation path of the bed 3 with respect to the supporting element 2, and so as to cause a movement of the end of the yarn guide 4 that is directed toward the bed 3 at right angles to the transverse direction on the plane of arrangement of said yarn guide 4.

In practice, in the illustrated arrangement, the coupling between the pins 14, 15 and the slots 16, 17 causes, during the passage of the yarn guide 4 from the inactive position to the active position, a lifting of the end of the yarn guide 4 with the passage 5 which allows it to pass above the bed 3 and then a lowering in order to insert the yarn 6 between the needles 13 and then, in the passage of the yarn guide 4 from the active position to the inactive position, a lifting in order to move beyond the bed 3 during return and deposit the yarn 6 in the recess 8 of the clamping and cutting element 7.

Conveniently, the first actuation means II comprise an actuator for each yarn guide 4 and such actuator can be actuated to produce the passage of the corresponding yarn guide 4 from the inactive position to the active position or vice versa, independently of the actuation of the other yarn guides 4.

Each actuator of the first actuation means 11 comprises a hydraulic cylinder 18, which is mounted on the supporting element 2 and is connected, by means of the stem 19*a* of its piston 19, to the corresponding yarn guide 4 in order to produce its passage from the inactive position to the active position or vice versa.

In the illustrated embodiment, the hydraulic cylinder 18 is provided with a chamber 20 inside which the piston 19 slides, dividing the chamber 20 into two parts: a first part 20*a*, which can be fed with a pressurized fluid, generally air, and a second part 20*b*, which is partially occupied by the stem 19*a* and also can be fed with a pressurized fluid, generally air. Feeding the first part 20*a* of the chamber 20 with a pressurized fluid and connecting the second part 20*b* of the chamber 20 to the discharge causes the translational motion of the piston 19 in one direction, which actuates the passage of the corresponding yarn guide 4 from the inactive position to the active position, while connection to the discharge of the first part 20*a* of the chamber 20 and introduction of the pressurized fluid in the second part 20*b* of the chamber 20 cause the motion of the piston 19 in the opposite direction with respect to the preceding direction and therefore cause the passage of the corresponding yarn guide 4 from the active position to the inactive position. It should be noted that for an equal pressure of the fluid that feeds the two parts 20*a*, 20*b* of the chamber 20, the second part 20*b* of the chamber 20 can be kept fed at all times, since the force applied to the piston 19 by the pressurized fluid in the second part 20*b* is smaller than the force applied to said piston 19 by the pressurized fluid in the first part 20*a* of the chamber 20, since the area of the piston 19 in the second part 20*b*, due to the presence of the stem 19*a*, is smaller than the area of the piston 19 in the first part 20*a*.

The second actuation means 12 comprise a single actuator for the different clamping and cutting elements 7. Such single actuator can be actuated to produce the passage of the clamping and cutting elements 7 from the clamping position to the waiting position and vice versa. Each clamping and cutting element 7 can move on command from a first active position, in which it can be engaged by such single actuator exclusively to be moved from the waiting position to the clamping position, to a second active position, in which it can be engaged by the single actuator exclusively to be moved from the clamping position to the waiting position.

More particularly, the single actuator for actuating the clamping and cutting elements 7 is constituted preferably by a hydraulic cylinder 21, which is supported by the supporting element 2 and is connected by means of the stem 22*a* of its piston 22 to a slider 23 which is supported, so that it can slide along an actuation direction which is substantially parallel to the actuation direction of the yarn guides 4, by the supporting element 2 and faces an end of the clamping and cutting elements 7 that is directed away from the end in which the recess 8 is defined.

Each clamping and cutting element 7 is pivoted, at an intermediate region of its extension, to the supporting element 2 about an axis 24 which is perpendicular to its plane of arrangement. The pivoting between the supporting element 2 and each clamping and cutting element 7 is performed by means of a pivot 25, the axis of which defines the axis 24, which is fixed to the supporting element 2, and by means of an elongated slot 26 which passes through the clamping and cutting element 7 and in which the pivot 25 passes. In this manner, each clamping and cutting element 7 can oscillate on its plane of arrangement about the axis 24 and can perform a translational motion along a direction which is substantially parallel to the actuation direction of the corresponding yarn guide 4.

By way of the oscillation about the axis 24 of the pivot 25, the clamping and cutting element 7 can pass from the first active position, in which its end directed toward the slider 23 is raised with respect to the slider 23 so that said slider cannot engage said end during the advancement of the slider 23 toward the bed 3, but can engage said end of the clamping and cutting element 7 during movement of the slider 23 away from the bed 3, to the second active position, in which the end of the clamping and cutting element 7 is lowered so as to be engaged by the slider 23 during the advancement of the latter toward the bed 3, which in this manner produces the passage of the clamping and cutting element 7 from the clamping position to the waiting position. In the second active position, the clamping and cutting element 7 cannot be engaged by the slider 23 in its motion away from the bed 3.

The hydraulic cylinder 21 is provided in a manner similar to the hydraulic cylinder 18, i.e., with a chamber 27 inside which the piston 22 slides, dividing the chamber 27 into two parts: a first part 27*a*, which can be fed with a pressurized fluid, generally air, and a second part 27*b*, which is partially occupied by the stem 22*a* and also can be fed with a pressurized fluid, generally air. The supply with a pressurized fluid of the first part 27*a* of the chamber 27 and the connection to the discharge of the second part 27*b* of the chamber 27 produce the translational motion of the piston 22 and therefore of the slider 23 toward the bed 3, actuating the passage of the corresponding clamping and cutting element 7, if such element is in the second active position, from the clamping position to the waiting position. The connection of the first part 27*a* of the chamber 27 to the discharge and the introduction of the pressurized fluid into the second part 27*b* of the chamber 27 produce the motion of the piston 22 in the opposite direction with respect to the preceding direction and therefore the motion of the slider 23 away from the bed 3. In this case also, for an equal pressure of the fluid that feeds the two parts 27*a*, 27*b* of the chamber 27, the second part 27*b* of the chamber 27 can be kept fed at all times, since the force applied to the piston 22 by the pressurized fluid in the second part 27*b* is smaller than the force applied to the piston 22 by the pressurized fluid in the first part 27*a* of the chamber 27, since the area of the piston 22 in the second part 27*b*, due to the presence of the stem 22*a*, is smaller than the area of the piston 22 in the first part 27*a*.

It should be noted that each clamping and cutting element 7, once it has been brought to the waiting position, only if it passes into the first active position can be engaged by the slider 23 while said slider performs a translational motion away from the bed 3 to be returned to the clamping position.

Conveniently, each of the yarn guides 4 is connected to the corresponding clamping and cutting element 7 to actuate the passage of the corresponding clamping and cutting element 7 from the first active position to the second active position upon passage of the corresponding yarn guide 4 from the inactive position to the active position.

The connection between the yarn guide 4 and the corresponding clamping and cutting element 7 is actuated by means of a pivot 28, which is fixed to the yarn guide 4 and is coupled slidingly to a side 29 which is contoured like an inclined plane of the corresponding clamping and cutting element 7. During the passage of the yarn guide 4 from the inactive position to the active position, the pivot 28 slides along the side 29 and causes the oscillation of the clamping and cutting element 7 about the axis 24, producing its passage from the first active position to the second active position.

The oscillation of each clamping and cutting element 7 in its passage from the first active position to the second active position is contrasted by elastic means, which are constituted preferably by an elastically flexible laminar tab 30 of the body of the clamping and cutting element 7 which rests against an abutment 31 defined by the supporting element 2. Such laminar tab 30 is loaded elastically by the oscillation of the clamping and cutting element 7 when said element passes from the first active position to the second active position and reacts elastically, causing the oscillation in the opposite direction of the clamping and cutting element 7, returning it to the first active position, when the action of the corresponding yarn guide 4 ceases thereon, i.e., when it is brought to the inactive position.

For the sake of completeness in description, it should be noted that FIGS. 1 to 4 illustrate two hydraulic cylinders 18, one of which acts on a yarn guide 4, shown in cross-section, while the other one acts on a contiguous yarn guide 4.

Operation of the device according to the invention is as follows.

Figure 5:
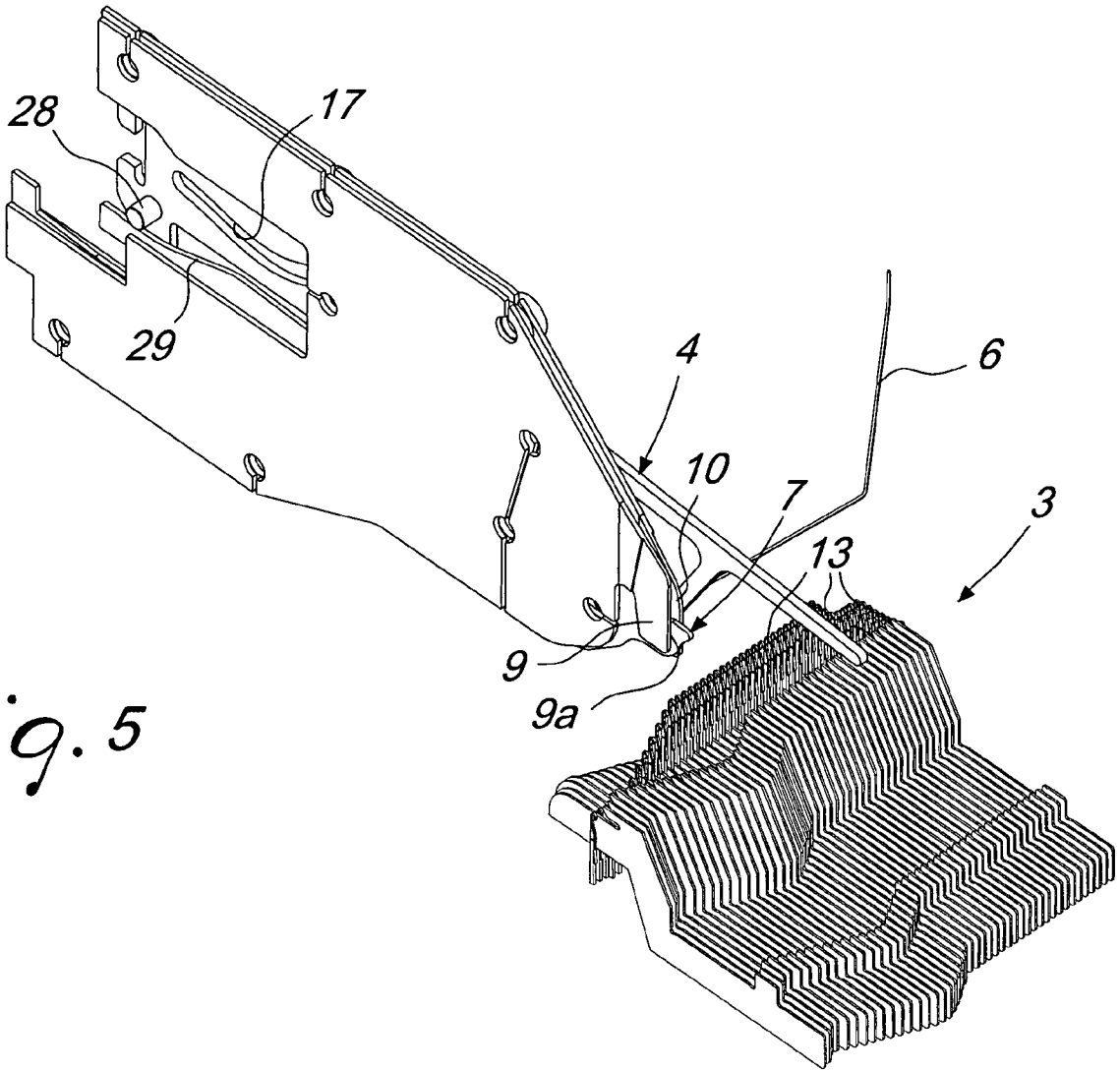
FIG. 5 is a perspective view of a part of the device according to the invention, with a yarn guide and the corresponding clamping and cutting element in the active condition shown in FIG. 1.

In inactive conditions, the different yarn guides 4 of the device are in the inactive position and the corresponding clamping and cutting elements 7 are in the clamping position, as shown in FIGS. 1 and 5.

Figure 2:
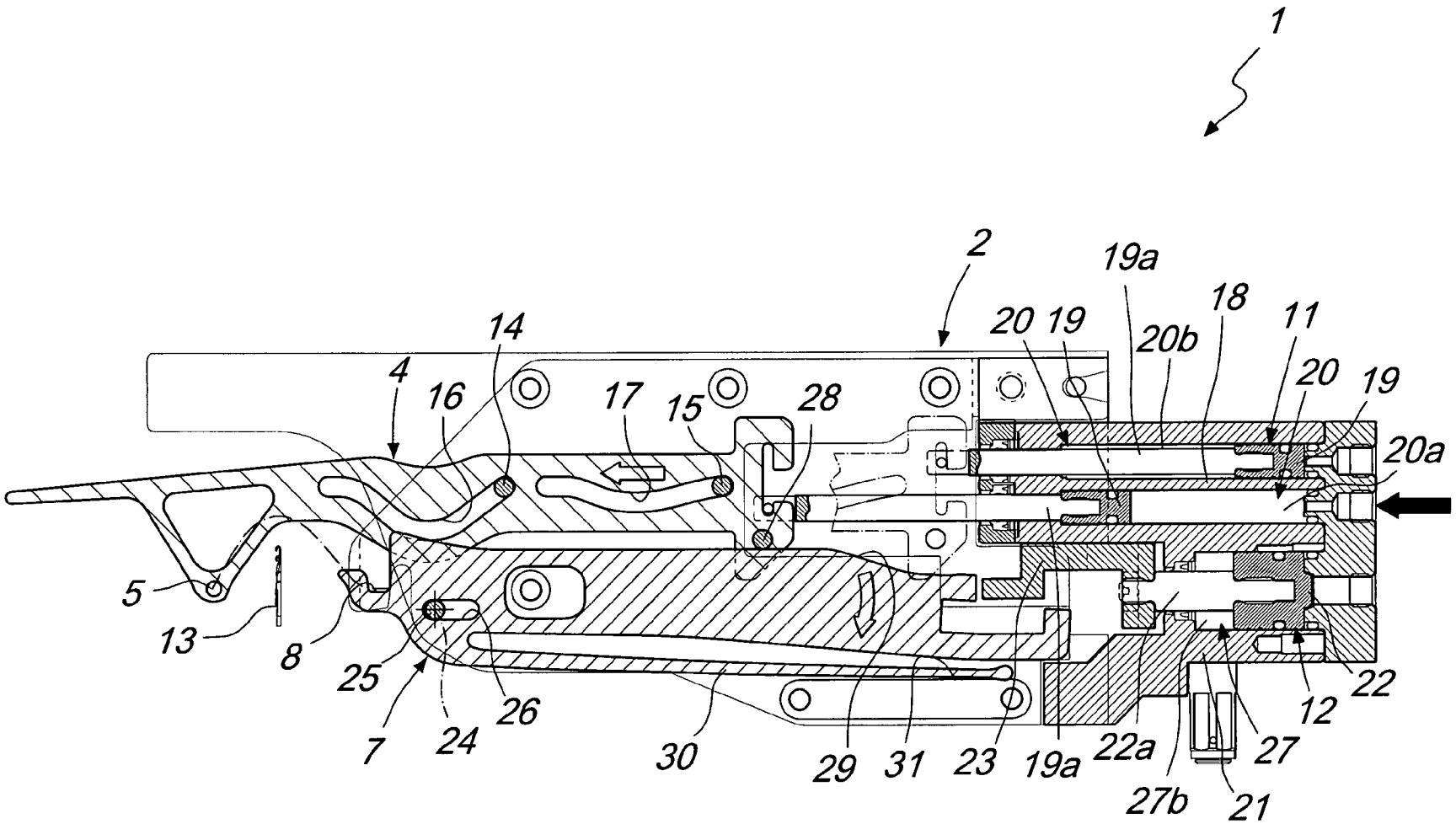
FIG. 2 is a view of the device according to the invention, similar to FIG. 1, with the yarn guide in the active position and with the clamping and cutting element in the clamping position and in a second active position.
Figure 6:
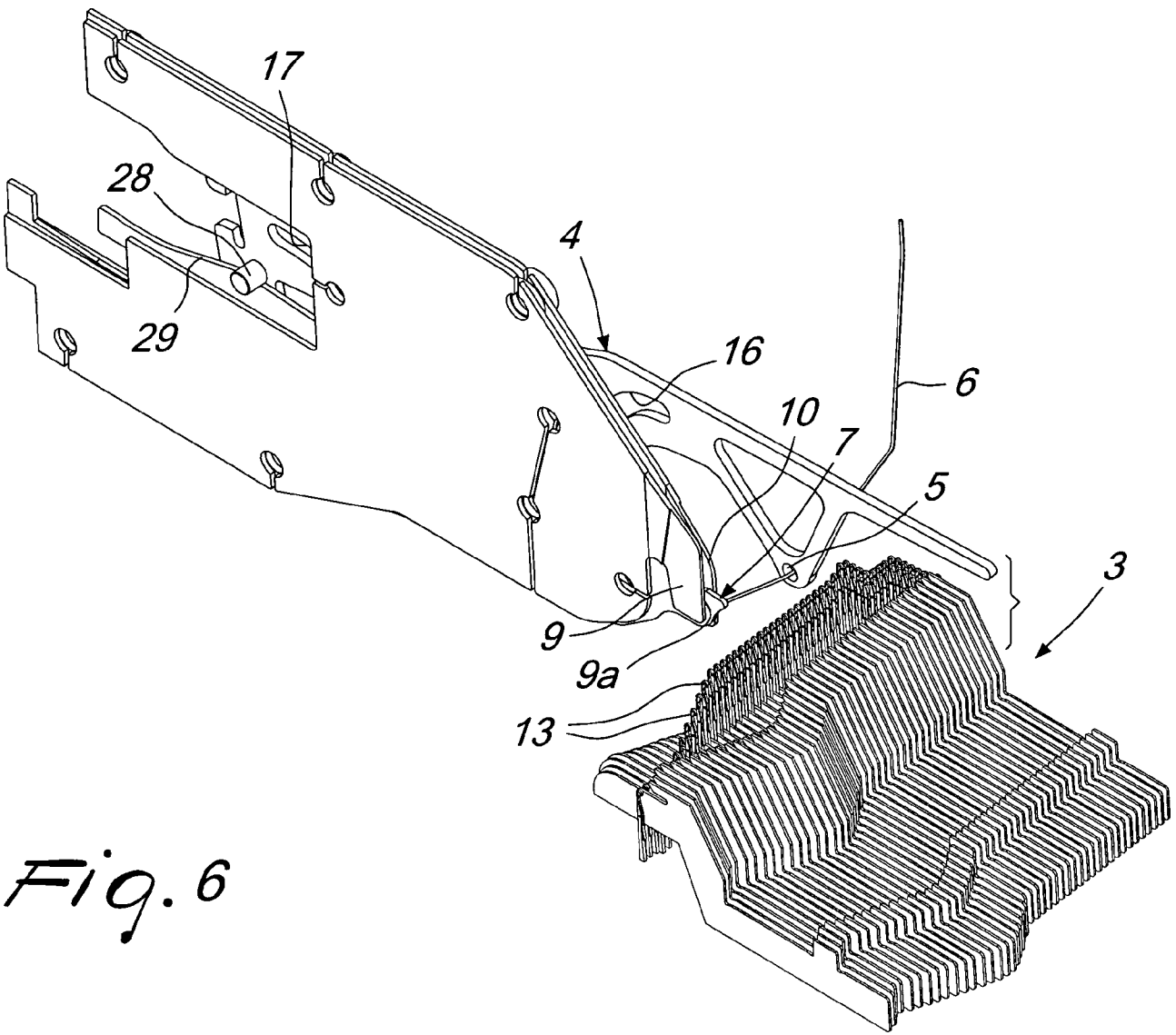
FIG. 6 is a view of a part of the device according to the invention, similar to FIG. 5, with the yarn guide during its passage from the inactive position to the active position.
Figure 7:
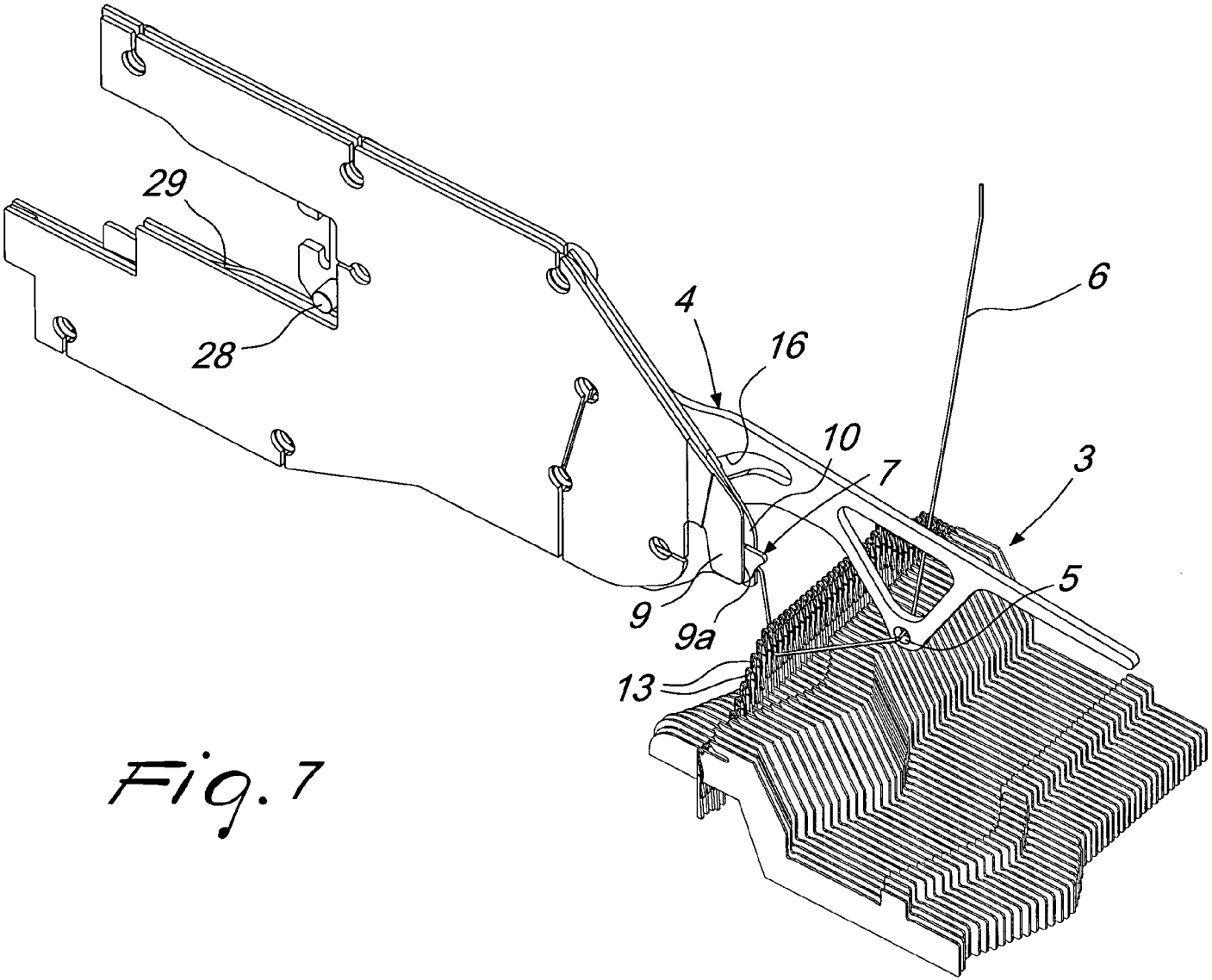
FIG. 7 is a view of a part of the device according to the invention, similar to FIGS. 5 and 6, in the active condition shown in FIG. 2.

When one wishes to provide a specific yarn 6 to the needles 13 of the machine, the yarn guide 4 that supports said yarn 6, by feeding with a pressurized fluid the first part 20*a* of the chamber 20 of the hydraulic cylinder 18, is moved from the inactive position to the active position. During this movement, the yarn guide 4, with its end in which the passage 5 is defined, rises (FIG. 6) so as to pass above the bed 3 and then descends so as to carry the yarn 6, with its portion that runs from the end that is clamped by the clamping and cutting element 7 to the passage 5 between two contiguous needles 13 supported by the bed 3, as shown in FIGS. 2 and 7. In this manner, one has the assurance that this portion of yarn 6 is engaged by the needles 13 of the bed 3 that are made to knit at the device being considered.

The passage of a yarn guide 4 from the inactive position to the active position also causes the passage of the corresponding clamping and cutting element 7 from the first active position to the second active position, loading elastically the laminar tab 30.

Figure 3:
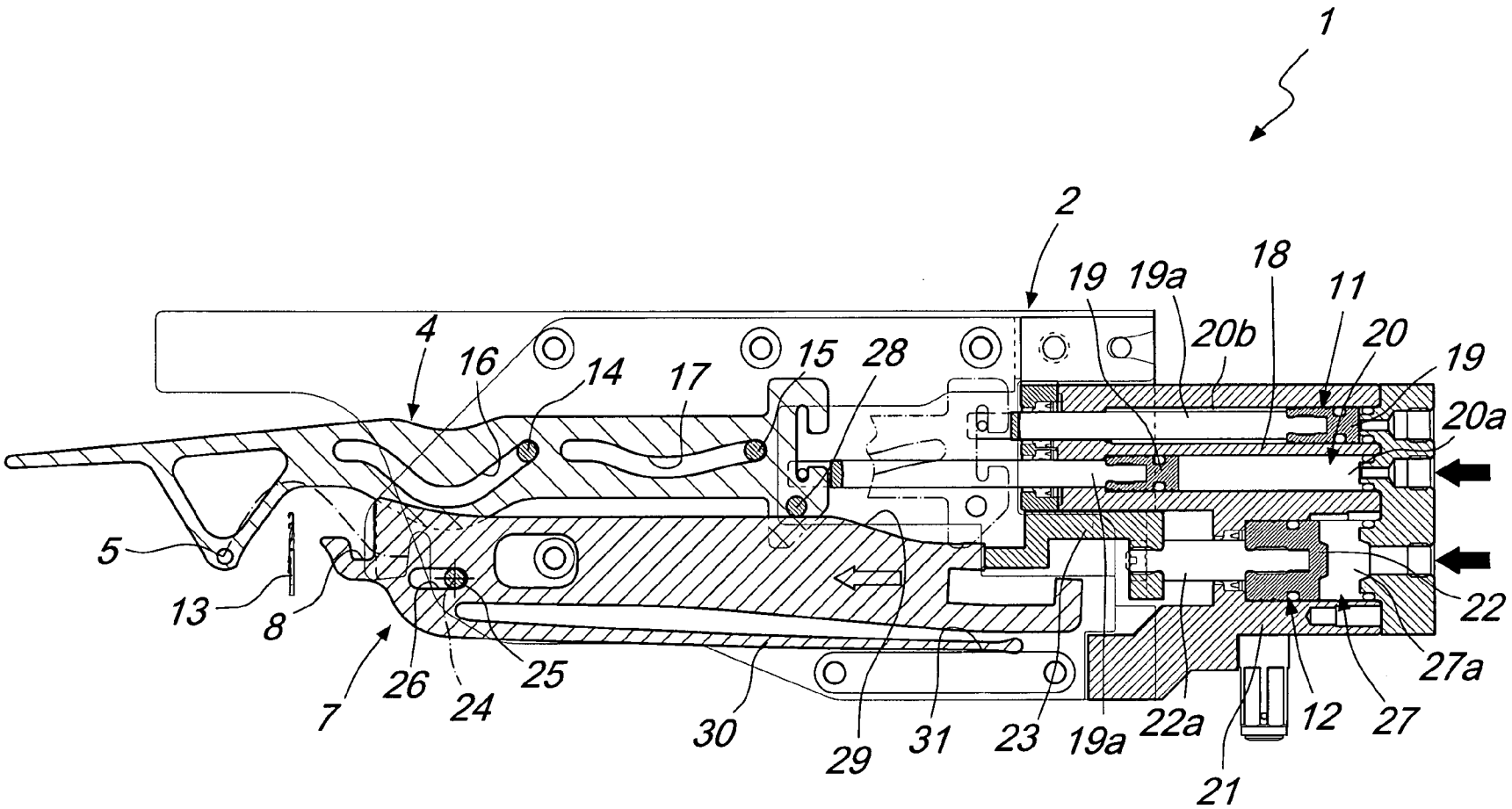
FIG. 3 is a view of the device according to the invention, similar to the preceding figures, with the yarn guide in the active position and with the clamping and cutting element in the waiting position.
Figure 4:
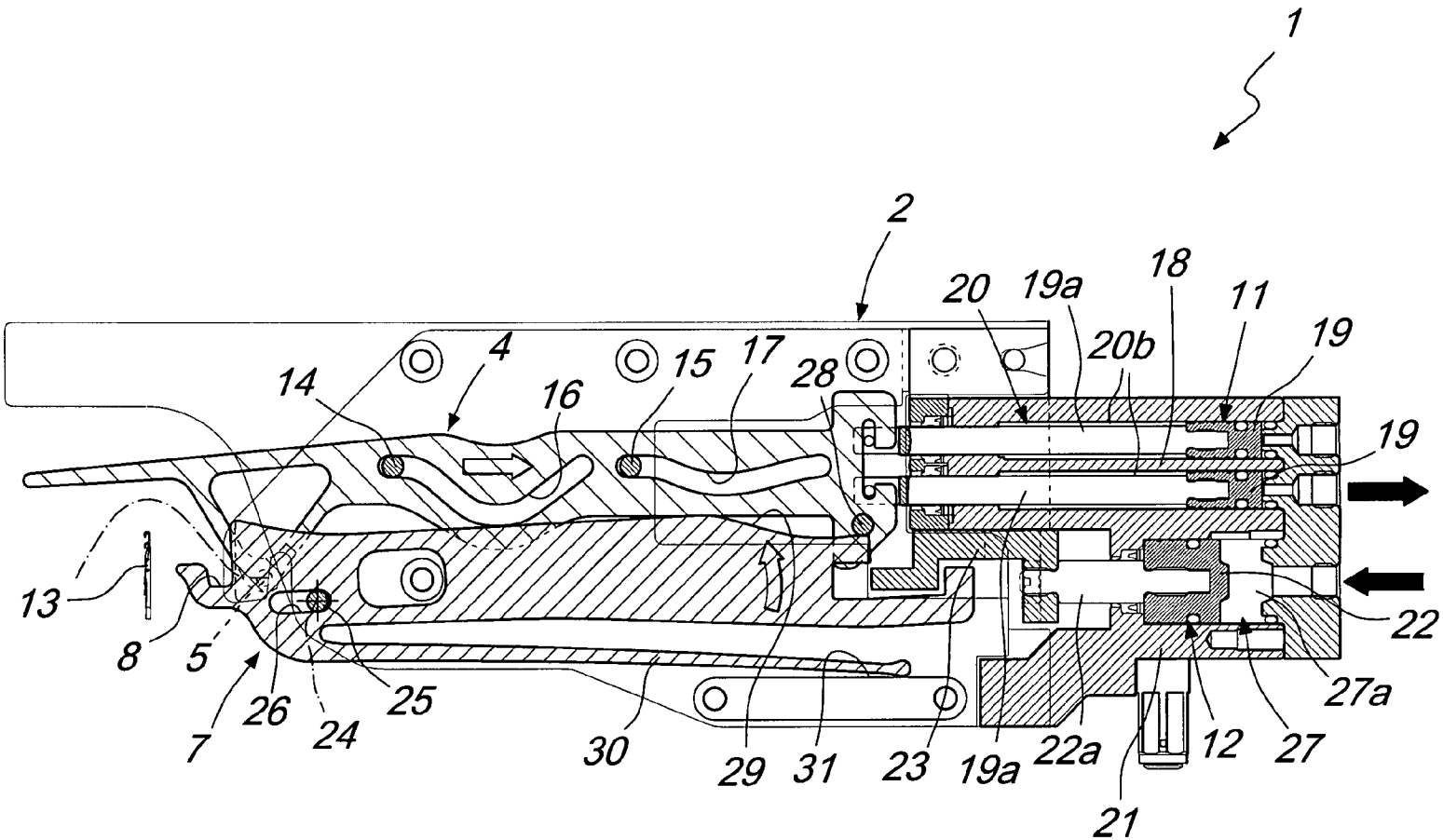
FIG. 4 is a view of the device according to the invention, similar to the preceding figures, with the yarn guide in the inactive position and with the clamping and cutting element in the waiting position and in the first active position.
Figure 8:
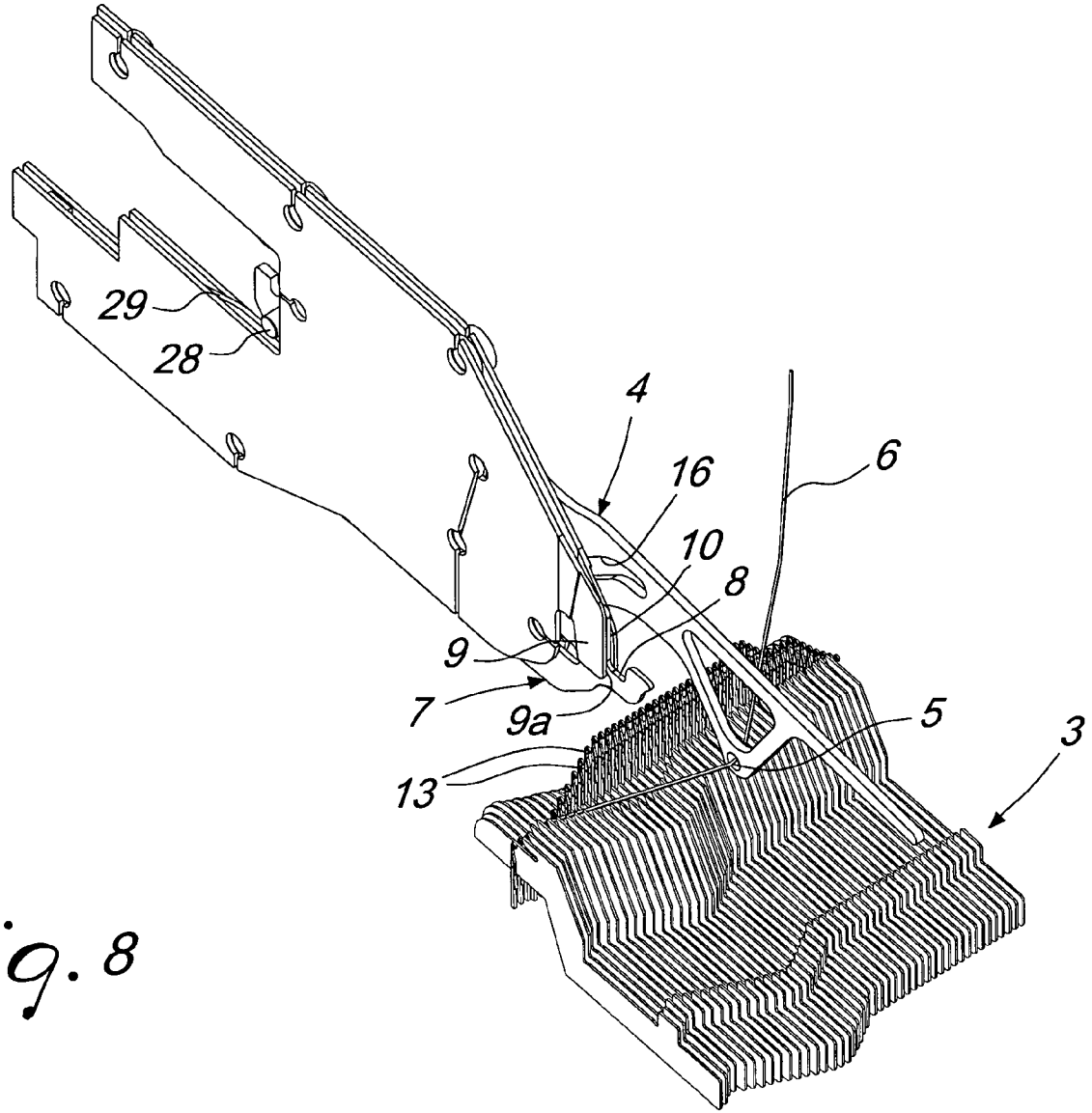
FIG. 8 is a view of a part of the device according to the invention, similar to FIGS. 5 to 7, with the yarn guide in the operating condition shown in FIG. 3.

Once the yarn guide 4 has been moved into the active position, the first part 20*a* of the chamber 20 of the hydraulic cylinder 21 is fed with pressurized fluid and produces the movement toward the bed 3 of the slider 23 and consequently the passage of the clamping and cutting element 7 from the clamping position to the waiting position in which it is extracted, with its end in which the recess 8 is defined, by the laminas 9 and 10 toward the bed 3. The passage of the clamping and cutting element 7 into the waiting position also frees the end of the yarn 6, previously clamped between the clamping and cutting element 7 and the retention lamina 10, allowing correct feeding of the needles 13 of the bed 3 which are moved to knit at the set of yarn guides, as shown in FIGS. 3 and 8.

Figure 9:
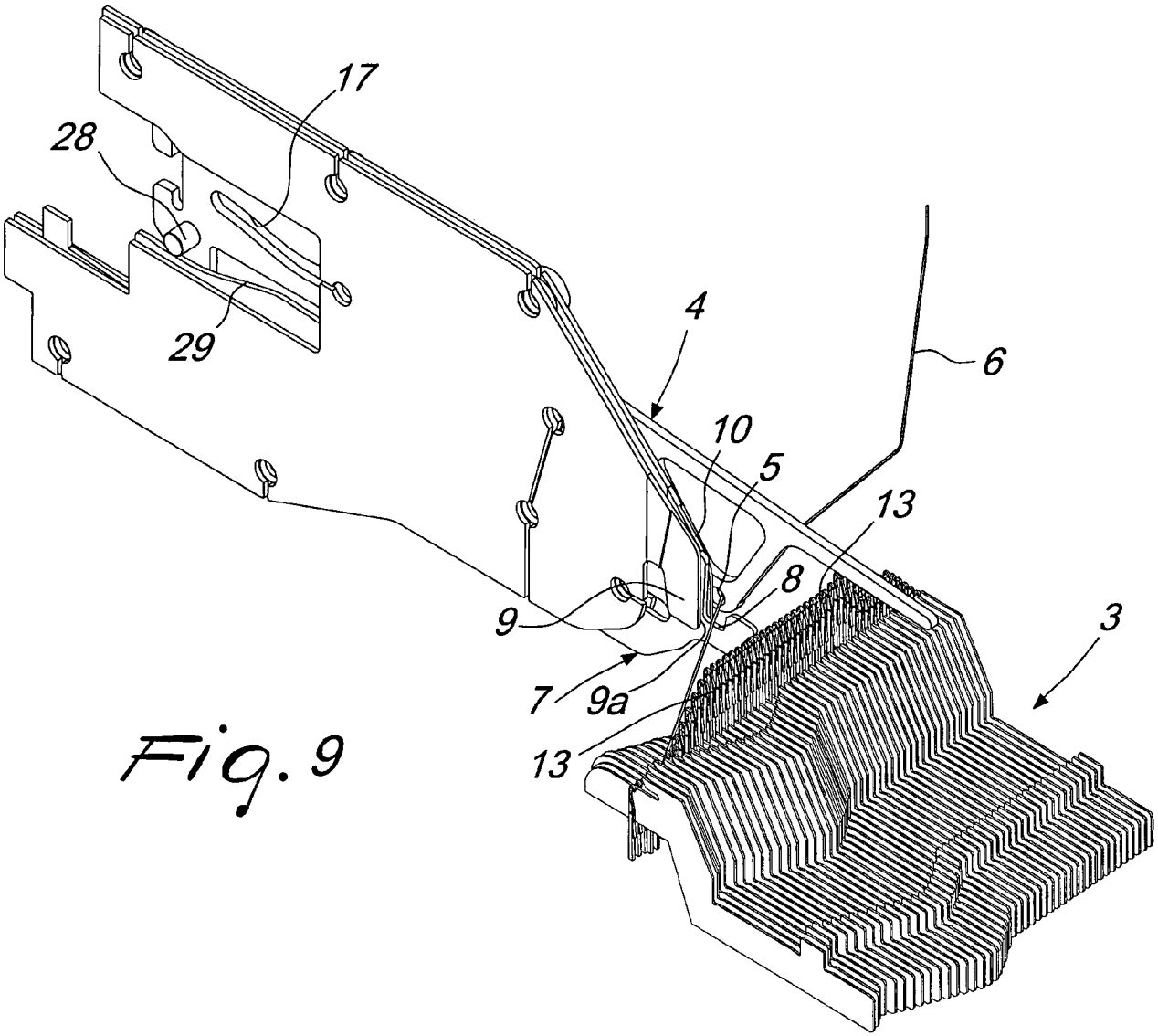
FIG. 9 is a view of a part of the device according to the invention, similar to FIGS. 5 to 8, during the passage of the yarn guide from the active position to the inactive position and with the corresponding clamping and cutting element in the waiting position.

When one wishes to interrupt the feeding of the yarn 6 dispensed by the yarn guide 4, the first part 20*a* of the chamber 20 of the hydraulic cylinder 18 is connected to the discharge, causing, as a consequence of the action of the pressurized fluid in the second part 20*b* of the chamber 20, the movement of its piston 19 and therefore of the yarn guide 4 away from the bed 3, returning the yarn guide 4 to the inactive position. During this spacing, the end with the passage 5 of the yarn guide 4 rises in order to move beyond the bed 3 and then descends again, depositing the portion of yarn 6 that runs from the passage 5 to the last needle 13 which has taken the yarn 6 in the recess 8, as shown in FIG. 9.

The return of the yarn guide 4 to the inactive position frees the corresponding clamping and cutting element 7, which as a consequence of the elastic reaction of the laminar tab 30 returns to the first active position.

The first part 27*a* of the chamber 27 of the hydraulic cylinder 21 is then connected to the discharge and, due to the action of the pressurized fluid in the second part 27*b* of the chamber 27, the piston 22 performs a translational motion away from the bed 3, causing the retraction of the clamping and cutting element 7 between the laminas 9 and 10, as shown in FIG. 1. This retraction causes the clamping of the yarn 6, deposited in the recess 8, between the retention lamina 10 and the clamping and cutting element 7 and the cutting of said yarn 6 between the clamping and cutting element 7 and the cutting lamina 9.

Due to the fact that each of the yarn guides 4 of the device according to the invention can be actuated independently of the actuation of the other yarn guides 4 and independently of the position of the bed 3 with respect to the position of the supporting element 2 which carries the yarn guides 4, it is possible to start and stop the feeding of a given yarn 6 at any time depending on the knitting requirements. In this manner it is possible to limit the dispensing of one or more yarns 6 to portions of rows of knitting, varying considerably the knitting possibilities, for example in forming patterns.

This possibility to actuate the yarn guides individually and without positional constraints with respect to the bed, in combination with the different possibilities of selection of the needles to be moved to knit at the yarn guides offered by modern knitting machines, extends considerably the range of kinds of knitting that can be performed on knitting machines.

In practice it has been found that the device according to the invention fully achieves the intended aim, since it allows to increase the number of kinds of knitting that are possible on a knitting machine.

The device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2006A001877 from which this application claims priority are incorporated herein by reference.

What is claimed is:

1. A knitting machine, comprising a supporting element which can be arranged on the inner side of the bed of the machine to be fed and supports a set of yarn guides arranged mutually side-by-side; said bed being able to move with respect to said supporting element along an actuation path; each of said yarn guides having a passage for at least one yarn to be fed to the needles of the machine that are arranged in said bed and said supporting element, for each of said yarn guides, supporting an element for clamping and cutting the yarn dispensed by the corresponding yarn guide; first actuation means for actuating the yarn guides being provided for the passage of said yarn guides from an inactive position, in which they are arranged so that their yarn passage lies on the inner side of the bed, to an active position, in which they are arranged so that their yarn passage lies on the outer side of the bed, or vice versa; and second actuation means being provided for actuating the clamping and cutting elements for the passage of the clamping and cutting elements from a position for clamping the yarn to a position for waiting for the yarn to be clamped; wherein said first actuation means are arranged on said supporting element and comprise individual actuators which can be actuated to produce the passage of each of said yarn guides from said inactive position to said active position or vice versa, independently of the actuation of the other yarn guides and independently of the position of said bed with respect to said supporting element along the corresponding actuation path.

2. The knitting machine according to claim 1, wherein said yarn guides, in passing from said inactive position to said active position, can move with respect to said supporting element along an actuation direction which is oriented transversely to the extension of the bed and transversely to said actuation path.

3. The knitting machine according to claim 2, wherein said yarn guides, in passing from said inactive position to said active position, can move with respect to said supporting element along a direction which is substantially perpendicular to said actuation direction on a plane which is substantially perpendicular to said actuation path.

4. The knitting machine according to claim 1, wherein said first actuation means comprise an actuator for each of said yarn guides, said actuator being actuatable to produce the passage of the corresponding yarn guide from said inactive position to said active position or vice versa regardless of the actuation of the other yarn guides.

5. The knitting machine according to claim 4, wherein each actuator of said first actuation means comprises a hydraulic cylinder which is mounted on said supporting element and acts, with the stem of its piston, on the corresponding yarn guide in order to make it pass from said inactive position to said active position or vice versa.

6. The knitting machine according to claim 1, wherein each of said yarn guides has an elongated laminar body which is arranged on a plane which is substantially perpendicular to said actuation path, said yarn passage being defined proximate to the longitudinal end of the yarn guide which is directed toward the bed.

7. The knitting machine according to claim 6, comprising means for guiding said yarn guides; said guiding means defining a path for the movement of said yarn guides in their passage from said inactive position to said active position and vice versa; said movement path having an intermediate lifting portion followed by a lowering portion for passage beyond the region of the bed that supports the needles on the part of the end of the yarn guide in which said yarn passage is defined, in the passage of the yarn guide from the inactive position to the active position and vice versa.

8. The knitting machine according to claim 1, wherein said second actuation means comprise a single actuator for the different clamping and cutting elements; said single actuator being actuatable in order to produce the passage of the clamping and cutting elements from said clamping position to said waiting position and vice versa; each clamping and cutting element being movable on command from a first active position, in which it can be engaged by said single actuator exclusively for its passage from said waiting position to said clamping position, to a second active position, in which it can be engaged by said single actuator exclusively for its passage from said clamping position to said waiting position.

9. The knitting machine according to claim 1, wherein each of said yarn guides is connected to the corresponding clamping and cutting element in order to actuate the passage of the corresponding clamping and cutting element from said first active position to said second active position upon passage of the corresponding yarn guide from said inactive position to said active position.

10. The knitting machine according to claim 1, comprising elastic return means which contrast elastically the passage of each clamping and cutting element from the first active position to the second active position in order to return said clamping and cutting element to the first active position when the inactive position is reached by the corresponding yarn guide.

11. The knitting machine according to claim 1, wherein said clamping and cutting elements have an elongated laminar body which is arranged on a plane which is substantially perpendicular to said actuation path.

12. The knitting machine according to claim 1, wherein said clamping and cutting elements are pivoted individually, with an intermediate portion of their extension, to said supporting element about a pivoting axis which is oriented substantially at right angles to the plane of arrangement of the corresponding clamping and cutting element; said clamping and cutting elements being able to oscillate about said pivoting axis with respect to said supporting element in order to pass from said first active position to said second active position or vice versa.

13. The knitting machine according to claim 1, wherein said knitting machines are circular knitting machines.

* * * * *